US007926422B2

(12) United States Patent
Marom et al.

(10) Patent No.: US 7,926,422 B2
(45) Date of Patent: Apr. 19, 2011

(54) PLATE TRANSPORT SPEED CONTROL SYSTEM

(75) Inventors: Moshe Marom, Kfar Saba (IL); Kalman Shamir, Herzlia (IL)

(73) Assignee: Eastman Kodak Company, Rochester, NY (US)

( * ) Notice: Subject to any disclaimer, the term of this patent is extended or adjusted under 35 U.S.C. 154(b) by 486 days.

(21) Appl. No.: 12/055,352

(22) Filed: Mar. 26, 2008

(65) Prior Publication Data

US 2009/0241791 A1 Oct. 1, 2009

(51) Int. Cl.
*B41F 27/12* (2006.01)

(52) U.S. Cl. ..... 101/477; 101/484; 271/256

(58) Field of Classification Search ..... 101/232, 101/477, 247, 480, 484, 485; 271/109, 110, 271/111, 256, 258.01, 259
See application file for complete search history.

(56) References Cited

U.S. PATENT DOCUMENTS

| | | | | |
|---|---|---|---|---|
| 5,634,406 | A | 6/1997 | Lindner et al. | |
| 6,428,162 | B2 * | 8/2002 | Kato | 347/104 |
| 7,329,058 | B1 | 2/2008 | Fromson et al. | |
| 2002/0008749 | A1 | 1/2002 | Kato | |

FOREIGN PATENT DOCUMENTS

| | | | |
|---|---|---|---|
| GB | 944743 | A | 12/1963 |

* cited by examiner

*Primary Examiner* — Ren Yan
(74) *Attorney, Agent, or Firm* — Nelson Adrian Blish

(57) ABSTRACT

An apparatus for preventing printing plate deformation (29) in a plate processor device comprising a plate transport means (19) comprising a motor (15) and plurality of rollers (11, 12, 13, 14). A one way coupler (21) connects the motor (15) and the plurality of rollers (11, 12, 13, 14). Identifying means identifies the slower rollers and decouples the slower rollers from the motor.

5 Claims, 3 Drawing Sheets

PLATE TRANSPORT SPEED CONTROL SYSTEM

FIELD OF THE INVENTION

The present invention relates to an apparatus and method for printing plate transport speed control inside a plate developing processor for the printing industry.

BACKGROUND OF THE INVENTION

Printing plate developing processors often utilize horizontal transport systems for incoming plates. The transport system typically comprises a plurality of motor driven rollers, and the rollers are covered with a flexible material such as rubber.

Referring to FIG. 1, plate 10 enters into the transport system 19 advancing in direction 18. The plate 10 is transported through the processor, assisted by several pairs of rollers 11, 12, 13, and 14. The upper rollers 11 and 14 touch the upper surface of plate 10 and the lower rollers 12 and 13 touch the lower surface of plate 10. The motor 15 rotates all the rollers (such as 11, 12, 13, and 14). During plate transport, the rollers are fastened to the plate surface and the rollers rotation causes the plate 10 to move forward in direction 18. This movement is achieved by transforming the angular velocity of the rollers (11, 12, 13, 14) into horizontal velocity of the moving plate 10.

The transformation of the angular velocity of the rollers into linear plate velocity is affected by the radius of the roller at the point of contact with the plate. The plate motion depends on the pressure applied to the rollers, the degree of rubber coating deterioration of the rollers, as well as other factors. The resulting differences of rollers radii may generate variable forces on plate 10, thus causing the plate to be deformed inside the processor, as it is illustrated by the deformed plate area 17.

SUMMARY OF THE INVENTION

Briefly, according to one aspect of the present invention a method for preventing printing plate deformation in a plate processor device comprises transporting the printing plate in a plate processor device comprising a motor and plurality of rollers. One way couplers connect the motor and the plurality of rollers. The slower rollers are identified and decouple from the motor.

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

In the following detailed description, reference is made to the accompanying drawings which form a part hereof, and in which is shown by way of illustration specific embodiments in which the method and apparatus may be practiced. Because components of embodiments of the present apparatus can be positioned in a number of different orientations, the directional terminology is used for purposes of illustration and is in no way limiting.

Figure 1:
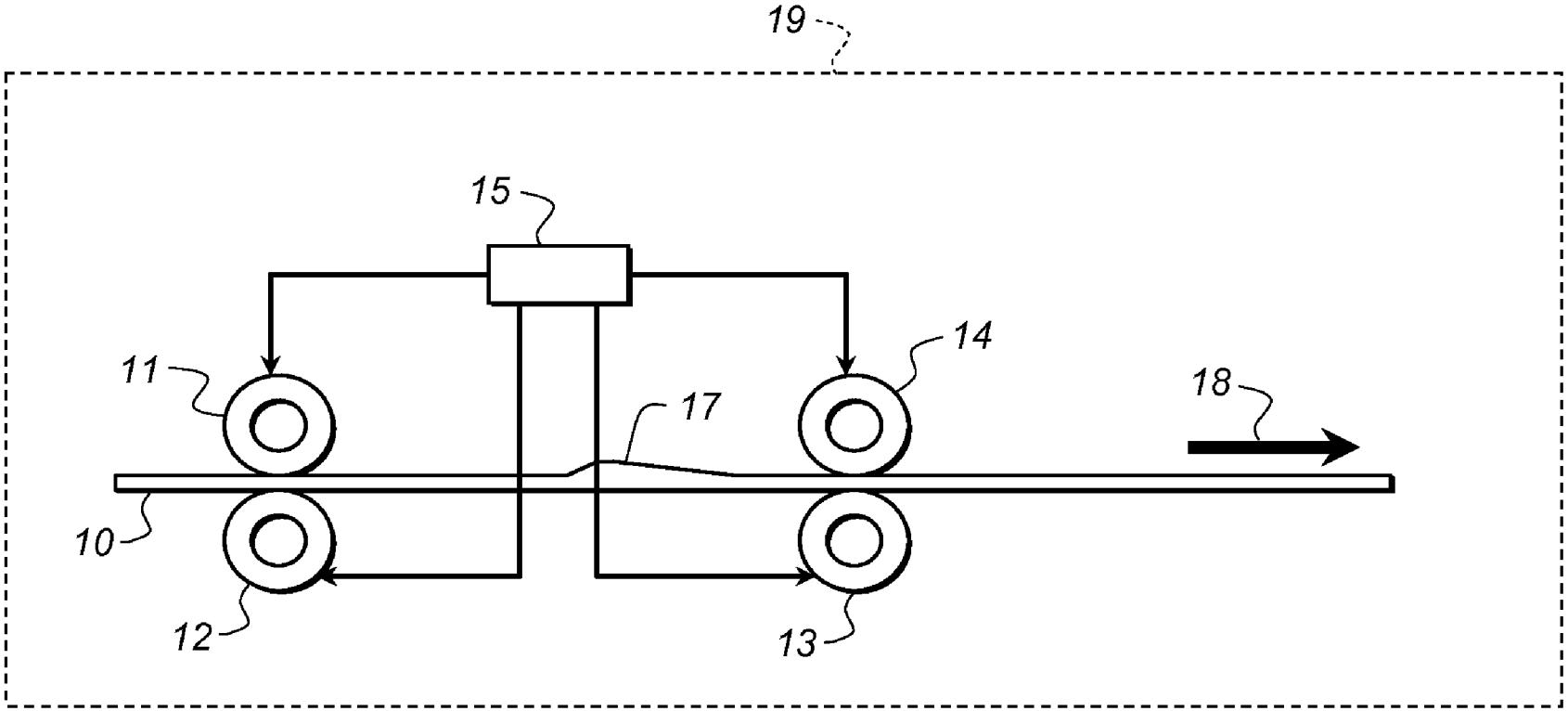
FIG. 1 (PRIOR ART)
FIG. 1 is a schematic drawing illustrating a prior art plate transport system.
Figure 2:
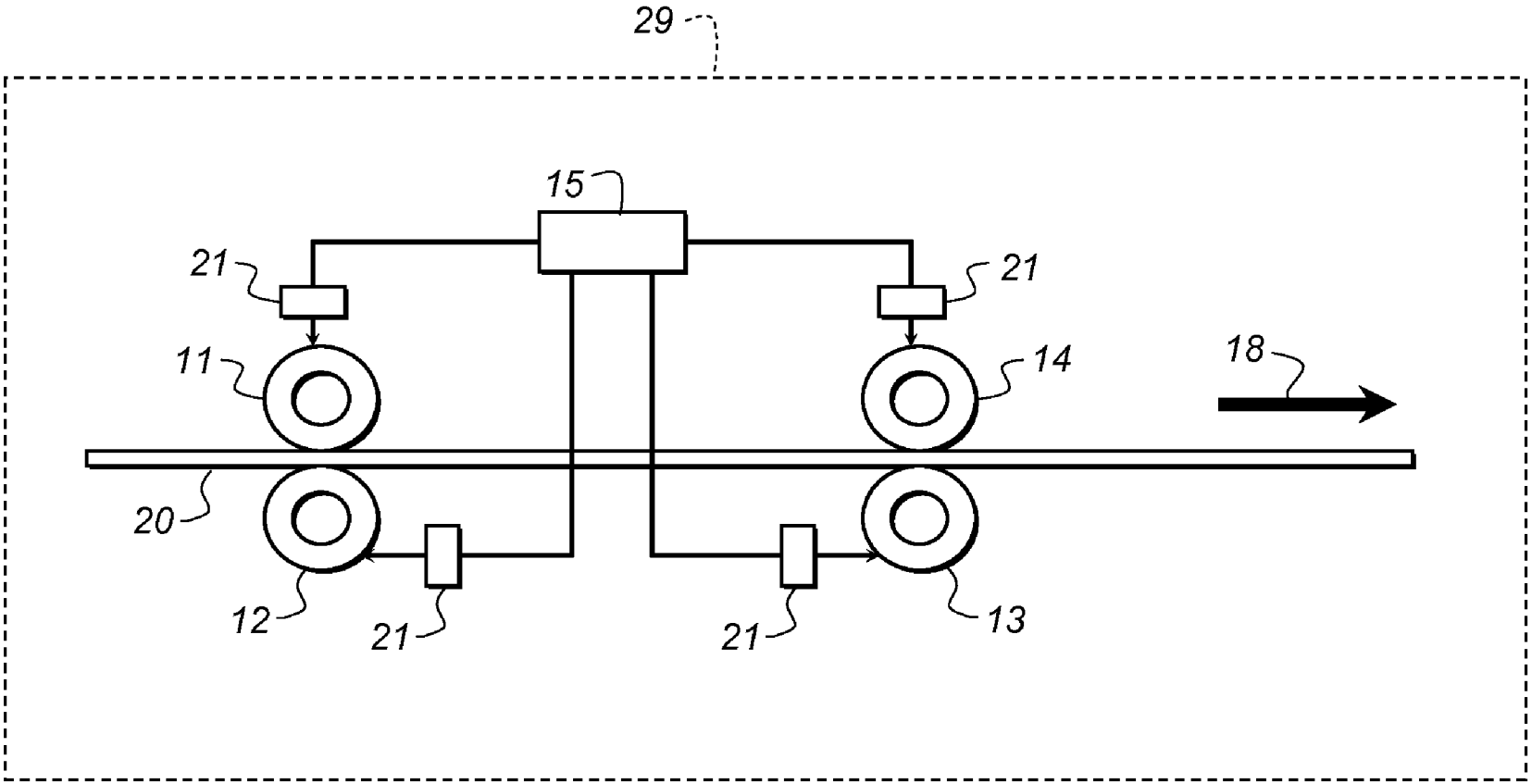
FIG. 2 is a schematic drawing illustrating a plate transport system using clutches to control the plate speed to prevent plate deformation.

The present invention solves the problem of plate deformation, folding, or stretching during the plate horizontal movement within a plate developing processor. Referring to FIG. 2, a clutch 21 is added to each of the rollers driven by motor 15 to form a clutch equipped transport system 29. A clutch 21 component which may be used is, for example, the type used in the bicycle industry.

The added clutches 21 will cause the roller with the fastest tangential velocity to prevail, and thus take control and drive plate 20. The control of all the other rollers will be inhibited by the clutches attached to them, and will cause those rollers to rotate at the speed of the advancing plate 20. This will result in elimination of contradictory forces that are applied on the plate 20 while transported in the clutch equipped transport system 29, thus preventing plate 20 from being deformed.

Figure 3:
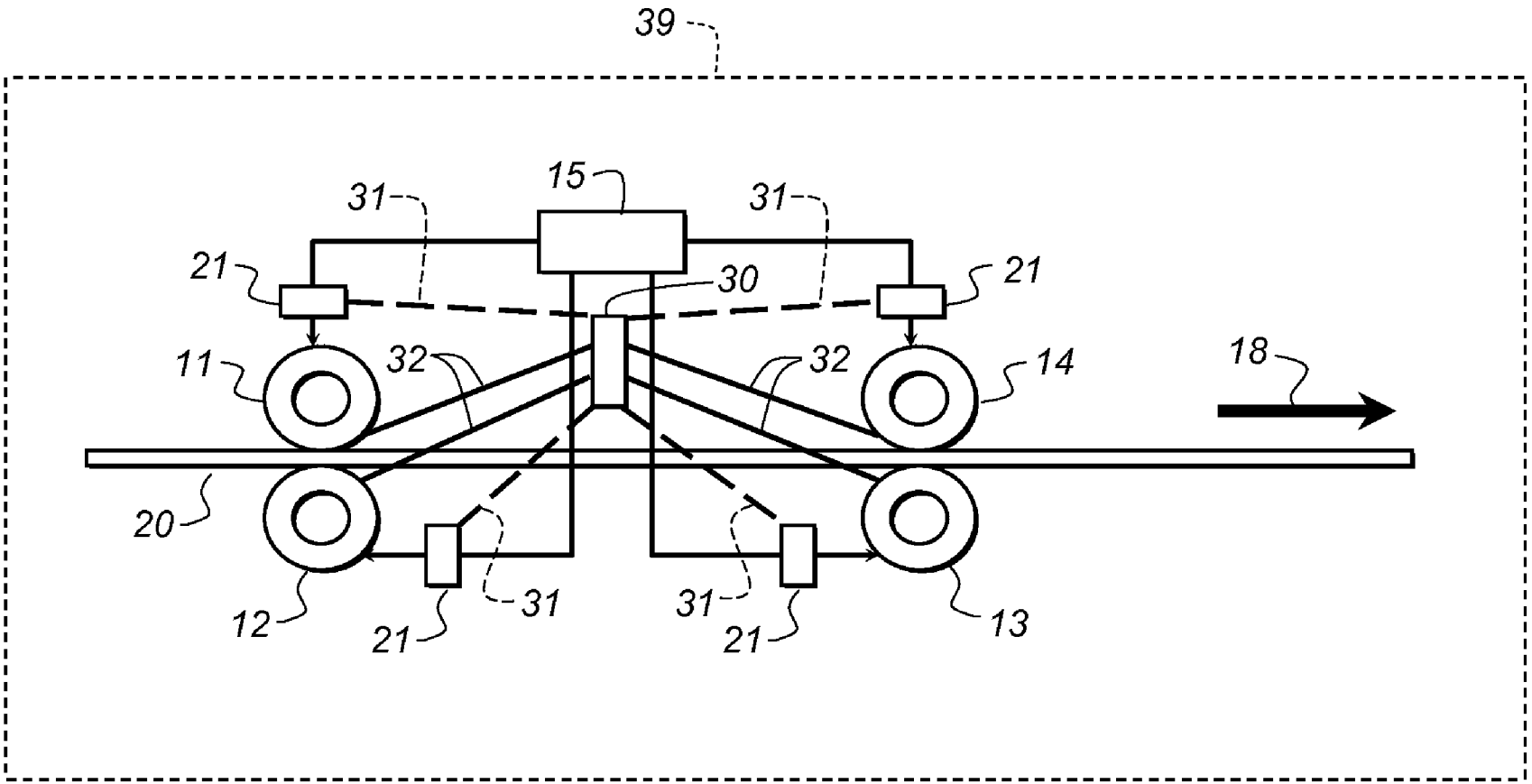
FIG. 3 is a schematic drawing illustrating a plate transport system using sensor and clutches to control the plate speed to prevent plate deformation.

In another embodiment a transport system 39 (in FIG. 3) using a different type of clutch is shown. A sensor 30 may be used to identify a slower roller, or roller pair, which is then decoupled. The sensor 30 senses the rollers (11-14) with sensing lines 31, and the clutches 21 are controlled by controlled lines 32, according to the results sensed from rollers (11-14).

The invention has been described in detail with particular reference to certain preferred embodiments thereof, but it will be understood that variations and modifications can be effected within the scope of the invention.

PARTS LIST

10 plate
11 roller
12 roller
13 roller
14 roller
15 motor
17 deformed plate area
18 plate direction
19 transport system
20 plate
21 clutch
29 clutch equipped transport system
30 sensor
31 roller sensing lines
32 control lines to couple or decouple clutches
39 clutch equipped transport system with sensor

The invention claimed is:

1. An apparatus for preventing printing plate deformation in a plate processor device comprising:

a plate transport comprising a motor and plurality of rollers rotating at a same desired speed by said motor;

one way couplers connecting said motor and said plurality of rollers;

a sensor configured to sense the actual speed of said plurality of rollers wherein said sensor is adapted to identify a first slow roller from said plurality of rollers that is rotating at a slower speed than the rest of said plurality of rollers; and a decoupling means for decoupling said slow roller from said motor.

2. The apparatus according to claim 1 wherein said one way couplers are clutches.

3. The apparatus according to claim 1 wherein a second slow roller is identified and decoupled.

4. A method for preventing printing plate deformation while in a plate processor device comprising the steps of:

a) transporting said printing plate in said plate processor device comprising a motor and plurality of rollers rotating at a same desired speed by said motor;

b) providing one way couplers connecting between said motor and said plurality of rollers;

c) identifying a slow roller from said plurality of rollers that is rotating at a slower speed than the rest of said plurality of rollers; and d) decouple said slow roller from said motor.

5. The method according to claim 4 wherein said one way couplers are clutches.

* * * * *